US005983392A

United States Patent [19]

Dutka

[11] Patent Number: 5,983,392

[45] Date of Patent: Nov. 16, 1999

[54] GARMENT

[76] Inventor: Hazel M. Dutka, 7522 Brinkworth Ln., Houston, Tex. 77070

[21] Appl. No.: 09/089,971

[22] Filed: Jun. 3, 1998

[51] Int. Cl.[6] ..... A41D 1/14

[52] U.S. Cl. ..... 2/69; 2/211; 2/71; 2/74

[58] Field of Search ..... 2/69, 47, 70, 71, 2/72, 73, 74, 75, 78.1, 78.2, 83, 114, 80, 211, 212, 213, 214, 243.1

[56] References Cited

U.S. PATENT DOCUMENTS

| | | | |
|---|---|---|---|
| 2,580,774 | 1/1952 | Helbig | 2/212 |
| 3,859,667 | 1/1975 | Roy | 2/212 |
| 3,916,901 | 11/1975 | Korgemets . | |
| 4,018,226 | 4/1977 | Korgemets . | |
| 4,068,315 | 1/1978 | Rainville . | |
| 4,106,125 | 8/1978 | Palumbo | 2/213 |
| 4,142,253 | 3/1979 | Roscoe . | |
| 4,290,148 | 9/1981 | Roberts . | |
| 4,524,463 | 6/1985 | Ogden . | |
| 4,578,824 | 4/1986 | Waldron . | |
| 4,651,353 | 3/1987 | Walden . | |
| 4,797,955 | 1/1989 | Garrett | 2/213 |
| 4,819,275 | 4/1989 | Lunt . | |
| 4,853,977 | 8/1989 | Foreman . | |
| 4,975,984 | 12/1990 | Sting . | |
| 5,025,501 | 6/1991 | Dillon . | |
| 5,184,351 | 2/1993 | Benstock . | |
| 5,228,141 | 7/1993 | Remsky et al. . | |
| 5,341,515 | 8/1994 | Cohen . | |
| 5,361,414 | 11/1994 | Smith . | |
| 5,465,425 | 11/1995 | Crispin . | |
| 5,546,608 | 8/1996 | Russano . | |
| 5,740,552 | 4/1998 | Smith . | |

OTHER PUBLICATIONS

Photographs of SKORTS (1997).

*Primary Examiner*—Gloria M. Hale
*Attorney, Agent, or Firm*—Arnold White & Durkee

[57] ABSTRACT

A garment is disclosed that includes: (1) a first panel having an upper edge, a lower edge, a left edge, and a right edge; (2) a second panel having an upper edge, a lower edge, a left edge, and a right edge; (3) a joining member which is attached to the lower edge of the first panel and to the lower edge of the second panel, the joining member being adapted to fit between a person's legs; (4) a first left tie extension which extends from the left edge of the first panel; (5) a first right tie extension which extends from the right edge of the first panel; (6) a second left tie extension which extends from the left edge of the second panel; and (7) a second right tie extension which extends from the right edge of the second panel. The first left tie extension and the first right tie extension are adapted to tie together in back of a person's waist, and the second left tie extension and the second right tie extension are adapted to tie together in front of the person's waist.

5 Claims, 3 Drawing Sheets

GARMENT

BACKGROUND OF THE INVENTION

The present invention relates to garments that can be worn on the lower half of a person's body.

Several types of garments are well known that cover a person's body below the waist but do not cover all of the person's legs. One example is short pants (referred to in this patent as "shorts"), which typically cover part but not all of the person's legs above the knee. Another example is "skorts," which are similar to shorts but with a flap across the front to create an exterior appearance somewhat similar to a skirt.

Shorts and skorts usually have a vertical fly in front. The fly is usually closed by a zipper and/or buttons. The use of a zipper or buttons may in some instances be undesirable, because of the possibility of a mechanical failure (such as a broken or lost button, or a broken zipper), or difficulty in manipulation in certain situations. Therefore, a need exists for improved shorts-like garments which allow free movement of a person's legs, but avoid the need for zippers or buttons.

SUMMARY OF THE INVENTION

One embodiment of the present invention is a garment that includes: (1) a first panel having an upper edge, a lower edge, a left edge, and a right edge; (2) a second panel having an upper edge, a lower edge, a left edge, and a right edge; (3) a joining member which is attached to the lower edge of the first panel and to the lower edge of the second panel, the joining member being adapted to fit between a person's legs; (4) a first left tie extension which extends from the left edge of the first panel; (5) a first right tie extension which extends from the right edge of the first panel; (6) a second left tie extension which extends from the left edge of the second panel; and (7) a second right tie extension which extends from the right edge of the second panel. The first left tie extension and the first right tie extension are adapted to tie together in back of a person's waist, and the second left tie extension and the second right tie extension are adapted to tie together in front of the person's waist.

In certain specific embodiments of the invention the first panel and second panel are generally rectangular. It is preferred that the first panel and second panel each be wide enough from their left edge to their right edge to wrap more than 50% of the distance around a person's waist but less than 100% of the distance around the person's waist.

When the garment of the present invention is actually being worn by a person, it can take the following form: (1) a first panel that is generally rectangular and has an upper edge, a lower edge, a left edge, and a right edge; the first panel covering the front of a person's abdomen below the person's waist and extending around both sides of the person's waist to the person's buttocks; (2) a first left tie extension which extends from the left edge of the first panel; (3) a first right tie extension which extends from the right edge of the first panel, with the first left tie extension and the first right tie extension being tied together in back of the person's waist, whereby the first panel is held in place on the person; (4) a second panel that is generally rectangular and has an upper edge, a lower edge, a left edge, and a right edge; the second panel covering the person's buttocks and extending around both sides of the person's waist to the front of the person's abdomen; (5) a second left tie extension which extends from the left edge of the second panel; (6) a second right tie extension which extends from the right edge of the second panel, with the second left tie extension and the second right tie extension being tied together in front of the person's waist, whereby the second panel is held in place on the person; and (7) a joining member that extends between the person's legs and that is connected to the lower edge of the first panel and to the lower edge of the second panel.

The garment of the present invention has several advantages. It provides the same degree of body covering as shorts, and allows the same freedom of movement and comfort. However, unlike shorts, the present invention can be taken on and off merely by tying and untying the extensions, somewhat like an apron, without the need to use zippers or buttons. Therefore, the present invention is a comfortable garment that is simple to manufacture and simple to wear.

DESCRIPTION OF ILLUSTRATIVE EMBODIMENTS

Figure 1:
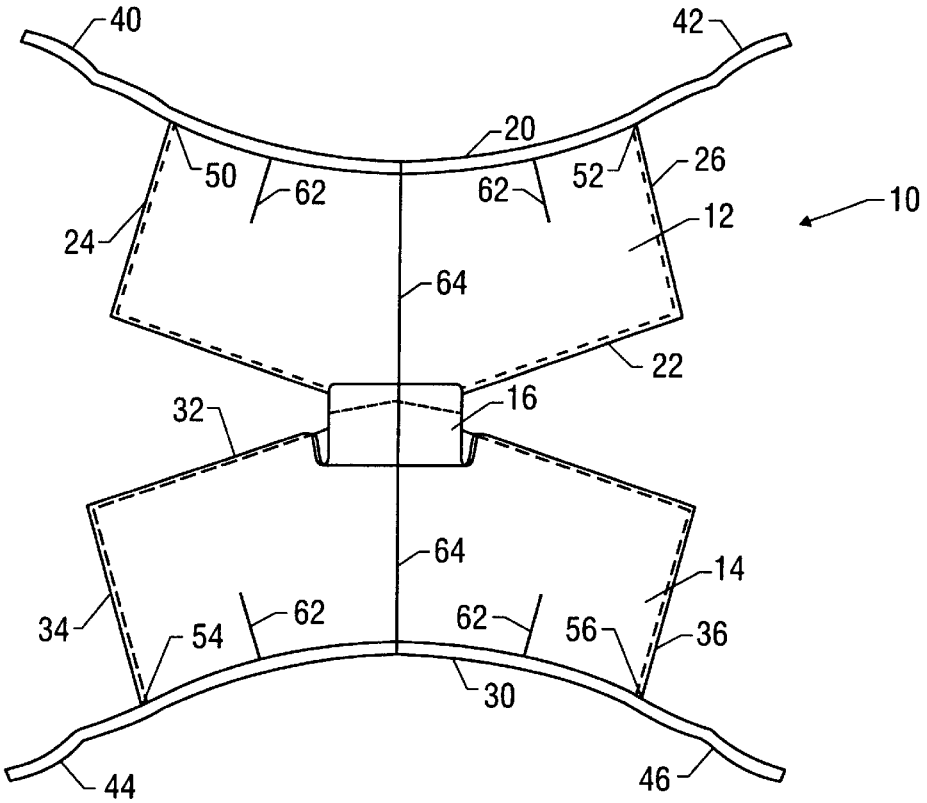
FIG. 1 is a top view of a garment of the present invention that has been laid flat.

A garment of the present invention can suitably take the form shown in FIG. 1. The garment 10 includes a first panel 12, a second panel 14, and a joining member 16. The first panel 12 is generally rectangular in shape, and has an upper edge 20, a lower edge 22, a left edge 24, and a right edge 26. Similarly, the second panel 14 has an upper edge 30, a lower edge 32, a left edge 34, and a right edge 36. The joining member 16, which is narrower than the two panels 12 and 14, is attached at one end to the lower edge 22 of the first panel, and at its other end to the lower edge 32 of the second panel.

Figure 2:
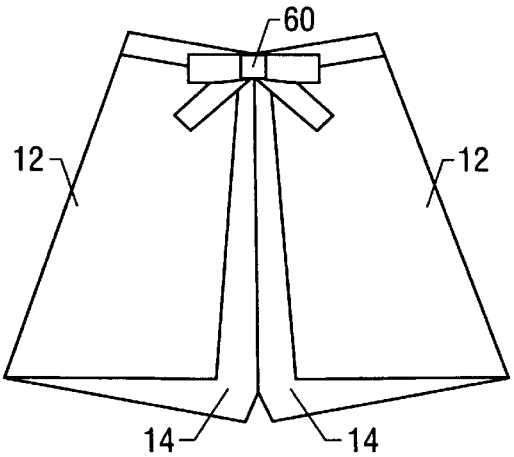
FIG. 2 is a front view of the garment as it would be seen when being worn by a person.
Figure 3:
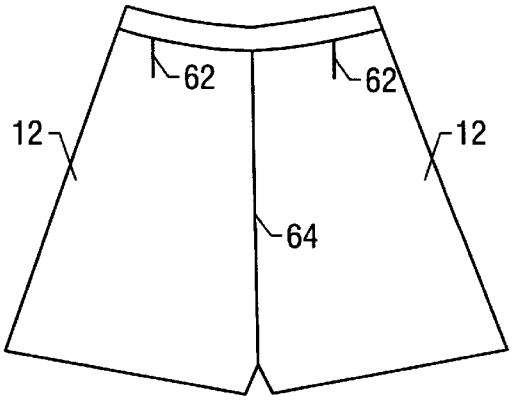
FIG. 3 is a rear view of the garment as it would be seen when being worn by a person.

The first panel also includes a first left tie extension 40, which extends from the point 50 where the upper edge and the left edge of the first panel intersect. The first panel similarly includes a first right tie extension 42, which extends from the point 52 where the upper edge and the right edge of the first panel intersect. The second panel likewise includes a second left tie extension 44, which extends from the point 54 where the upper edge and the left edge of the second panel intersect; and a second right tie extension 46, which extends from the point 56 where the upper edge and the right edge of the second panel intersect. The tie extensions 40, 42, 44, and 46 are flexible enough to allow them to be tied together, for example in a bow 60 as shown in FIG. 2, as will be explained in more detail below.

It is possible but not required to form the first left tie extension 40 and the first right tie extension 42 from a single piece of material which extends along the upper edge 20 of the first panel 12.

One or both of the panels can optionally include pleats 62, for decorative purposes or to make the garment fit better.

Depending on whether the panels 12 and 14 are each made from a single piece of material or multiple pieces of material, a seam 64 may be visible in a panel.

Figure 4:
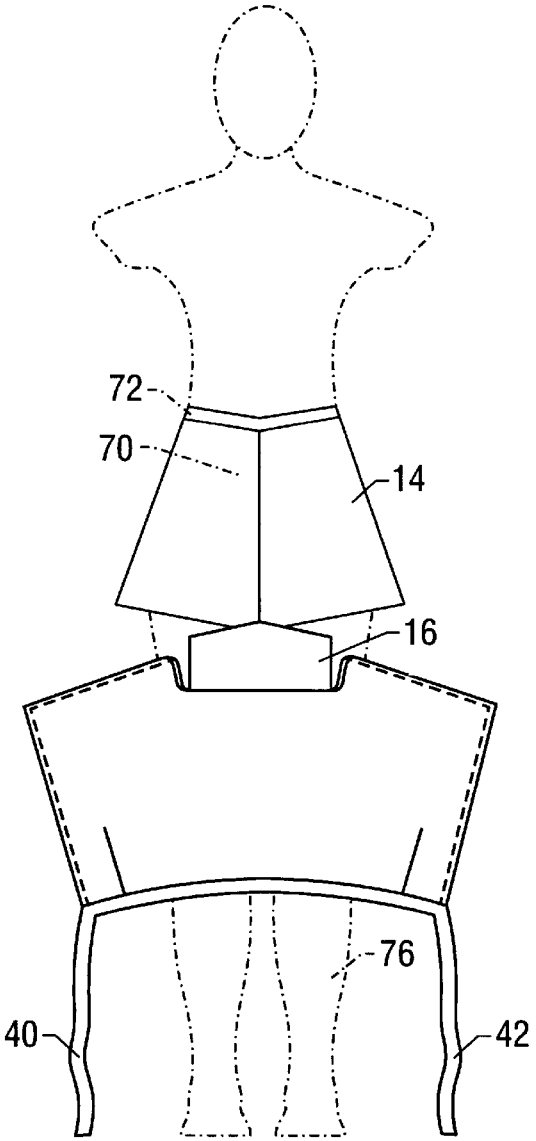
FIG. 4 is a front view of a person in the process of putting on the garment.
Figure 5:
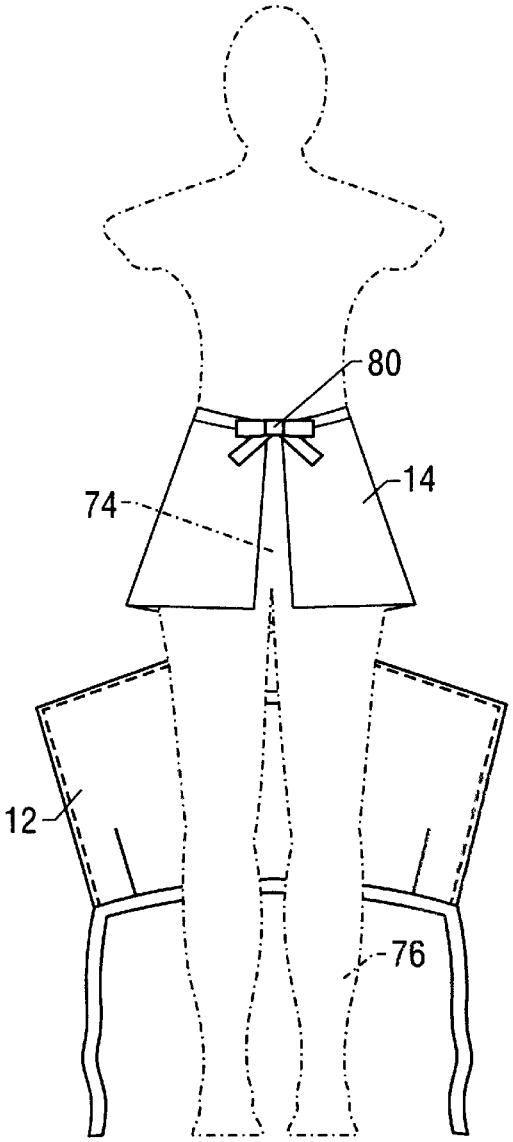
FIG. 5 is a rear view of the person in the process of putting on the garment, at the same point in that process as is shown from the front in FIG. 4.

A person can put on the garment as shown beginning in FIG. 4. The second panel 14 is placed in front of the person's abdomen 70 below the person's waist 72. The second left tie extension 44 and the second right tie extension 46 are pulled around the sides of the person's waist to the rear, and are tied in a rear bow 80 as shown in FIG. 5. Thus the second panel 14 covers the front of the person's abdomen below the person's waist as shown in FIG. 4, and also covers part but not necessarily all of the person's buttocks 74 as shown in FIG. 5. At this point the joining member 16 and the first panel 12 hang down in front of the person's legs 76, as can be seen in FIGS. 4 and 5.

Figure 6:
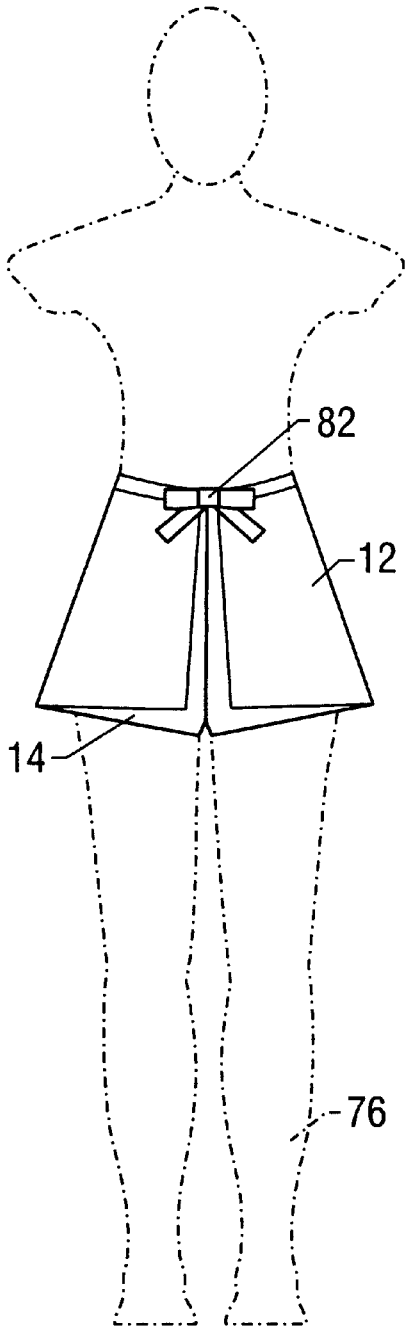
FIG. 6 is a front view of a person wearing the garment.
Figure 7:
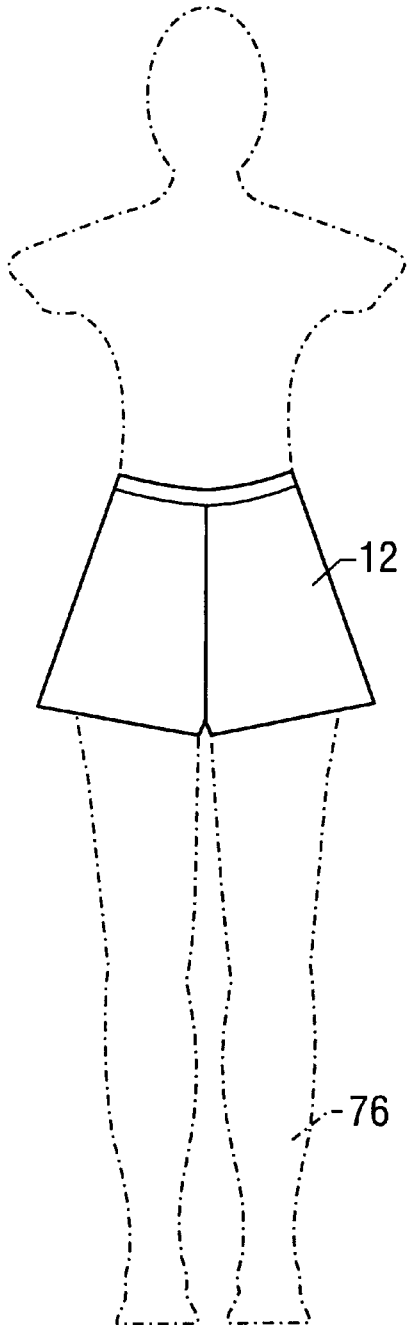
FIG. 7 is a rear view of a person wearing the garment.

After the second panel 14 is secured in place on the person by tying the tie extensions 44 and 46 together into the rear bow 80, the first panel 12 is pulled back between the person's legs and up in back of the person, so that the first panel covers the person's buttocks. At this point the upper edge 20 of the first panel 12 is located near the person's waist in back of the person. The first left tie extension 40 and the first right tie extension 42 are pulled around the sides of the person's waist toward the front, so they can be tied together into a front bow 82 as shown in FIG. 6. The joining member 16 extends between the person's legs, and holds the first panel 12 and the second panel 14 together from their lower edges.

Thus, when the garment is worn by a person, the first panel 12 is visible from the front and from the back of the person. The second panel 14 will usually be visible to some extent from the front of the person. If the first panel 12 is made wide enough to completely encircle the person's waist, then the second panel 14 could be completely covered. It is usually preferably that the first panel and the second panel each be wide enough to pass more than 50% of the distance around the person's waist, but that they are not so wide that they will pass 100% of the distance around the person's waist.

The garment of the present invention can be made in a variety of sizes. The vertical size of the two panels (i.e., the distance from the upper edge to the lower edge) can be selected so as to cover the desired amount of the person's legs 76. The garment can be made from a variety of materials. Cotton fabric is one suitable example. It is also possible to add other structures to the exterior of the garment for decorative purposes. For example, buttons could be attached to the exterior without being passed through a buttonhole, so that they would be nonfunctional as fasteners.

The preceding description of specific embodiments of the present invention is not intended to be a complete list of every possible embodiment of the invention. Persons skilled in this field will recognize that modifications can be made to the specific embodiments described here that would be within the scope of the present invention.

What is claimed is:

1. A garment, comprising:

a first panel having an upper edge, a lower edge, a left edge, and a right edge;

a second panel having an upper edge, a lower edge, a left edge, and a right edge;

a joining member which is attached to the lower edge of the first panel and to the lower edge of the second panel, the joining member being adapted to fit between a person's legs;

a first left tie extension which extends from the left edge of the first panel;

a first right tie extension which extends from the right edge of the first panel;

a second left tie extension which extends from the left edge of the second panel;

a second right tie extension which extends from the right edge of the second panel;

where the first left tie extension and the first right tie extension are adapted to tie together in back of a person's waist; and where the second left tie extension and the second right tie extension are adapted to tie together in front of a person's waist.

2. The garment of claim 1, where the first panel and second panel are generally rectangular.

3. The garment of claim 2, where the first panel and second panel are each wide enough from their left edge to their right edge to wrap more than 50% of the distance around a person's waist but less than 100% of the distance around a person's waist.

4. The garment of claim 2, where:

the first left tie extension extends from a point adjacent the intersection of the upper edge and the left edge of the first panel;

the first right tie extension extends from a point adjacent the intersection of the upper edge and the right edge of the first panel;

the second left tie extension extends from a point adjacent the intersection of the upper edge and the left edge of the second panel; and the second right tie extension extends from a point adjacent the intersection of the upper edge and the right edge of the second panel.

5. A garment worn by a person, comprising:

a first panel that is generally rectangular and has an upper edge, a lower edge, a left edge, and a right edge; the first panel covering the front of a person's abdomen below the person's waist and extending around both sides of the person's waist to the person's buttocks;

a first left tie extension which extends from the left edge of the first panel;

a first right tie extension which extends from the right edge of the first panel;

where the first left tie extension and first right tie extension are tied together in back of the person's waist, whereby the first panel is held in place on the person;

a second panel that is generally rectangular and has an upper edge, a lower edge, a left edge, and a right edge; the second panel covering the person's buttocks and extending around both sides of the person's waist to the front of the person's abdomen;

a second left tie extension which extends from the left edge of the second panel;

a second right tie extension which extends from the right edge of the second panel;

where the second left tie extension and the second right tie extension are tied together in front of the person's waist, whereby the second panel is held in place on the person; and a joining member that extends between the person's legs and that is connected to the lower edge of the first panel and to the lower edge of the second panel.

* * * * *